United States Patent [19]

Weber et al.

[11] 3,967,180

[45] June 29, 1976

[54] POWER SUPPLY SYSTEM FOR EXTRACTION MACHINE, ESPECIALLY A DRUM-CUTTING MACHINE

[75] Inventors: Karl-Heinz Weber, Witten-Heven; Hans Nohendorf, Dorsten, both of Germany

[73] Assignee: Gebr. Eickhoff, Maschinenfabrik und Eisengiesserei m.b.H., Bochum, Germany

[22] Filed: Dec. 9, 1974

[21] Appl. No.: 530,820

[30] Foreign Application Priority Data

Dec. 11, 1973 Germany ..... 2362107

[52] U.S. Cl. ..... 320/13; 307/39; 317/18 C

[51] Int. Cl.[2] ..... H02J 7/00; H02H 1/02

[58] Field of Search ..... 307/38, 39, 10 B; 320/8–13, 14, 48; 180/65 R; 105/49, 50, 364; 191/4; 317/18 C

[56] References Cited

UNITED STATES PATENTS

| | | | |
|---|---|---|---|
| 2,784,322 | 3/1957 | Johnson | 307/39 |
| 3,196,316 | 7/1965 | Crom | 317/18 C |
| 3,457,491 | 7/1969 | Black et al. | 320/48 |

FOREIGN PATENTS OR APPLICATIONS

| | | | |
|---|---|---|---|
| 486,212 | 12/1917 | France | 320/13 |

*Primary Examiner*—J. D. Miller
*Assistant Examiner*—Robert J. Hickey

[57] ABSTRACT

Low voltage direct current power is provided on a mining machine that is supplied with high voltage alternating current by an external power cable. An intrinsically-safe battery is charged by a battery charger that is powered through a stepdown transformer by the high voltage current supplied to the machine only during the actual operation thereof. The battery powers two separate electrical systems and in one system low voltage current continuously powers essential electrical devices that must remain functional even though the mining machine is not performing a mining operation. The other electrical system powers electrical devices that are essentially operative only when the mining machine is operative and this system is automatically deenergized by a relay in the high voltage current supply line.

6 Claims, 2 Drawing Figures

Figures 1, 2:
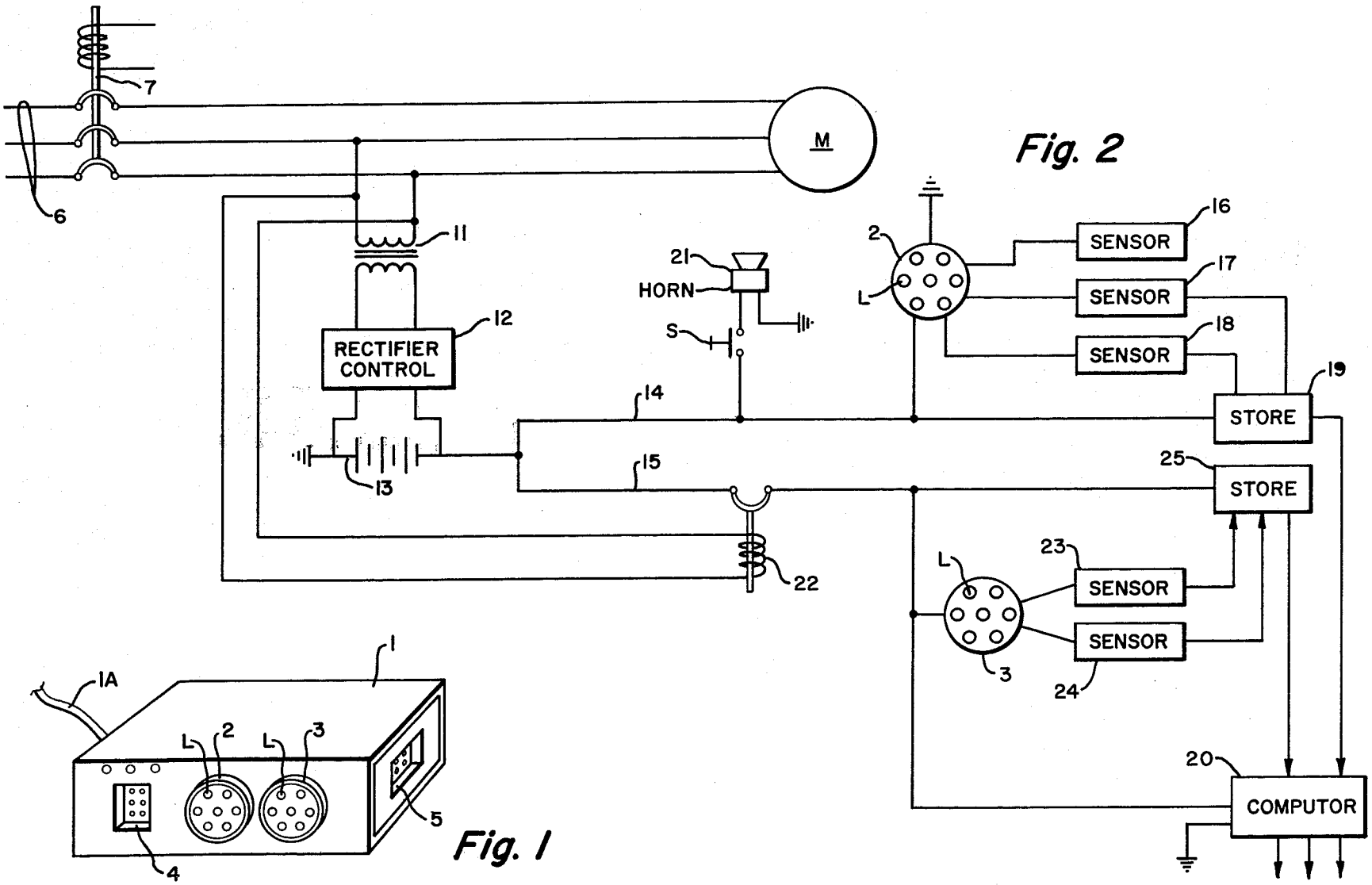

SENSOR
SENSOR
SENSOR
STORE
STORE
COMPUTOR
SENSOR
SENSOR
HORN
RECTIFIER CONTROL
M

POWER SUPPLY SYSTEM FOR EXTRACTION MACHINE, ESPECIALLY A DRUM-CUTTING MACHINE

BACKGROUND OF THE INVENTION

The present invention relates to a system for the efficient use of low voltage current supplied by a battery that is coupled to a battery charger onboard an extracting machine for the mining of coal or ore. More particularly, the present invention relates to a control system which disconnects the low voltage current from the battery to one of two groups of devices which are unessential at times when the extracting machine is non-operational and therefore the battery is not being charged by the high voltage current supply.

As is known in the art, it has already been proposed to equip extracting machines, especially drum-cutting machines, with an onboard battery which can be charged by an electrical system coupled to the power supply lines in a trailing cable. Among other things, such a battery has been used to supply electrical power for monitoring and fault-indicating devices on the extracting machine as well as for a memory store section of an onboard computer. Moreover, the battery is utilized to produce a warning signal typically by means of a horn, which is sounded when the drive motor is being started. This warning signal provides an indication to operating personnel in the immediate vicinity of the mining machine that the drive motor is about to be started up and that the mining cutters are about to work on the mine face.

During the operation of the extracting machine, the onboard battery thus continuously supplies electrical energy to two groups of electrical load devices. The first of these groups consists of electrical devices which become non-functional at the time when the extracting machine is at rest and non-operational. The electrical load devices belonging to the second group must remain functional even though the machine is at rest. The devices belonging to the second group include a plurality of means for providing measurements of operating parameters including measurements taken during the preceding cutting operation and indicators associated therewith to enable a continuous indication of such information to operating personnel. While not so limited, the present invention is particularly adapted to include the use of indicating apparatus of the type shown and described in copending application Ser. No. 398,422.

The underground site requirements and conditions place restrictions which dictate that an underground extraction machine must be constructed in a compact manner. This restricts available space and it places narrow limitations to the possibilities for housing a chargeable battery within the body of the extracting machine. Therefore, the physical dimensions of the battery must be held within specified limitations and this, of course, restricts the electrical storage capacity of the chargeable battery.

SUMMARY OF THE INVENTION

It is an object of the present invention to restrict and limit the number of electric load devices which are powered by a chargeable battery onboard an extracting machine when it is turned OFF.

It is a further object of the present invention to provide a control system to automatically disconnect a chargeable battery from electric load devices which are coupled in a circuit that is non-functional at times when the extracting machine is non-operational.

It is another object of the present invention to limit the storage capacity of a rechargeable battery and thereby its physical dimensions for accommodation within available and restricted space within a mining machine while concurrently limiting the number of load devices which are powered by the battery throughout the times while the machine is in an inoperative mode.

The present invention, therefore, provides a mining machine, including a drum-cutting mining machine of the type in which at least one drive motor is supplied with high voltage current by an external cable essentially only during the times of required power movement by the machine and wherein the mining machine includes an intrinsically-safe enclosure containing at least a chargeable battery which is coupled to charging means powered by the intermittent supply of high voltage current to the mining machine, the chargeable battery supplying low voltage current for two separable groups of control, monitoring and/or indicating devices with one group consisting of devices performing non-essential functions when the mining machine is non-functional, the improvement which comprises first means for passing the low voltage current from the chargeable battery to the above-said one group of devices that are operative essentially only when the mining machine is functional as defined by the time when the machine is supplied with high voltage current, second means independent of the first means for continuously powering the second and separate group of devices with low voltage current from the chargeable battery for continuous operation of such devices which are essential to the mining machine and independent of the functional status thereof, and means for disabling the operation of the first-mentioned means in the absence of a supply of high voltage current to the mining machine.

In order to solve the aforementioned problems, the present invention starts with the extraction machine, especially a drum-cutting extraction machine which is equipped with a chargeable, intrinsically-safe battery connected to a charging means powered by high voltage current supply to the mining machine. The chargeable battery is coupled in circuits supplying electrical energy to two groups of load devices consuming electrical energy, the arrangement being such that one of the two groups of devices consists of sensors and/or indicators which perform no useful function when the extracting machine is at rest or not operating. The problem solved by the present invention is characterized by the fact that the two groups of devices consuming electrical current are arranged in two separate circuits each including the chargeable battery. The circuit powering the sensors and/or indicators that are not needed when the extraction machine is at rest, is provided with a circuit breaker having its contacts conductive only at times when the battery is receiving a charging current supplied from the high voltage current supply. Thus, whenever the extraction machine is switched OFF or the passage of current to the mining machine ceases, then the absence of such a voltage is used to interrupt the circuit containing the monitoring devices which are not needed when the machine is at rest. Consequently, the physical dimensions and the capacity of the chargeable battery can be designed and selected to fall within the limit set by the space available within the mining machine as well as to meet the power requirements for the longest period of time at which the machine can be expected to remain inoperative.

According to another characteristic of the invention, a relay-type of circuit breaker is controlled by the current supply to the battery charging circuit. The arrangement of parts is such that the relay is deenergized when the extracting machine is switched OFF or when the current supply to the machine ceases and thus opens one of the two circuits which is powered by the battery.

These features and advantages of the present invention as well as others will be more fully understood when the following description is read in light of the accompanying drawings, in which:

FIG. 1 is a perspective view of an intrinsically-safe enclosure for a chargeable battery for providing two sources of low voltage current according to the features of the present invention; and FIG. 2 is a schematic circuit wiring diagram of the low voltage power supply system of the present invention.

With reference now to FIG. 1 of the drawings, there is shown a pressure-tight housing 1 forming an intrinsically-safe enclosure within which there is located a chargeable battery and, if desired, a portion of the electrical circuit illustrated in FIG. 2. According to the features and advantages of the present invention, the intrinsically-safe enclosure 1 has a reduced size arising out of the fact that the battery within the housing has reduced dimensions and capacity since it is only necessary that the battery supply current continuously to one of two load circuits. This takes on fundamental importance because the rechargeable battery and associated circuitry must be mounted within a compartment of an extraction machine. While such a machine is not illustrated in the drawings, it is a specially-designed and engineered type of mining machine to occupy a minimum of space and therefore severely restrict the available space within the machine wherein the battery can be housed. On the face of the intrinsically-safe housing 1, indicators 2 and 3 are located, each of which includes lamps L and may be constructed in accordance with the teachings disclosed in Ser. No. 398,422, filed Sept. 18, 1973. A power cable lead-in is identified by reference numeral 1A. This cable is coupled by connectors, not shown, carried by the housing 1 which is additionally provided with suitable electrical connector plugs 4 and 5. These plugs may be used to form the two separate electrical systems of the present invention.

The circuitry shown in FIG. 2, which may be incorporated within the housing 1, is coupled to a high voltage current supply transmitted over lines 6, usually a three-phase alternating current. A main line contactor 7 is used for coupling the high voltage current to a drive motor M for the extraction machine. One phase of the power supply for the drive motor M is connected through transformer 11 to a rectifier and control circuit 12 which supplies a charging current to a direct current chargeable battery 13. The battery is continuously charged while the mining machine is in motion and the battery continuously supplies low voltage electrical current for two separate load circuits which include leads 14 and 15. The load circuits include monitoring, counters, computers, measuring devices, indicating devices and switch-on locking devices. According to the present invention, these load devices are collected into two separate groups, one consisting of load devices which exercise no function when the machine is at rest and the other group consisting of load devices required to continuously operate during times when the extraction machine is at rest as well as during its powered movements. The load circuit formed by conductor 14 forms the load circuit that continuously operates and the low voltage electrical current is used to energize the lamps L of the indicator 2 as well as power the external sensors 16, 17 and 18 which may comprise temperature sensors, pressure sensors and the like. These sensors respond to an off-normal condition of the mining machine and they will activate one of the lamps L of the indicator 2 to indicate the off-normal condition. Sensors 17 and 18 may additionally supply input data to a store 19 having its output coupled to a computer 20. It is to be understood, of course, that the store 19 is continuously powered by the low voltage current in line 14 but the computer 20 may, as desired, be powered only during times of power movement by the mining machine. Line 14 may additionally supply low voltage current through a switch S to energize a horn 21 or other type of sounding device.

A contactor or relay 22 on the mining machine is activated by the supply of high voltage alternating electrical current to the transformer 11. This high voltage current as described hereinbefore exists only during times of powered operation by the mining machine. Thus, low voltage current is intermittently conducted by line 15A to power, for example, the lamps L of the indicating device 3 which is connected to external sensors 23 and 24 which may comprise temperature sensors and pressure sensors or the like. The sensors will activate one of the lamps L on the indicator 3 to indicate the off-normal condition. The sensors 23 and 24 may additionally form inputs to a store 25 that receives a low voltage electrical current over line 15A and provides input data to the computer. When the extracting machine and particularly the drive motor M is switched OFF or when high voltage current ceases to flow in line 7, the contactor or relay 22 disconnects line 15 from line 15A and therefore the source of low voltage current is not conducted to the load devices powered in the circuit by line 15A. In this way, the capacity and, therefore, the physical dimensions of the battery 13 can be designed and matched to meet the longest anticipated period of time during which continuous operation is required by the load devices powered by line 14.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. In a mining machine including a drum-cutting mining machine of the type in which at least one drive motor is supplied with high voltage current via an external power cable essentially only during times of required powered movement by the machine and wherein the mining machine includes an intrinsically-safe enclosure containing at least a chargeable battery which is coupled to charging means powered by the intermittent supply of high voltage current to the mining machine, said chargeable battery supplying low voltage current for two separate groups of control, monitoring and/or indicating devices with one group consisting of devices performing non-essential functions to the mining machine when it is non-functional, the improvement which comprises:

first means for passing the low voltage current from said chargeable battery to said one group of devices which is operatively essential only when the mining machine is functional as defined by the time when the machine is supplied with high voltage current, second means independent of said first means for continuously powering the second and separate group of said devices with low voltage current from said chargeable battery for continuous operation of such devices which is essential to the mining machine and independent of the operative status thereof, and means responsive to the absence of a supply of high voltage current to the mining machine for disabling the operation of said first means.

2. The improvement according to claim 1 wherein said means for disabling operation includes a circuit breaker on the mining machine responsive to the supply of high voltage current thereto.

3. The improvement according to claim 1 wherein said means for disabling operation includes a relay carried on the mining machine and rendered conductive by the supply of high voltage current to the mining machine.

4. The improvement according to claim 1 in which said battery is carried within an intrinsically-safe enclosure.

5. The improvement according to claim 1 wherein said battery and said battery charging means are enclosed within an intrinsically-safe housing carried by said mining machine.

6. The improvement according to claim 1 wherein said drive motor is powered by a three-phase alternating current supply including transformer means for connecting one phase of said three-phase supply to said battery charging means.

* * * * *